US009269506B2

(12) United States Patent
Kim

(10) Patent No.: US 9,269,506 B2
(45) Date of Patent: Feb. 23, 2016

(54) MOVABLE CONTACT ARM FOR MOLDED CASE CIRCUIT BREAKER AND MOVABLE CONTACT ARM ASSEMBLY

(71) Applicant: LSIS CO., LTD., Anyang-si, Gyeonggi-do (KR)

(72) Inventor: Min Kyu Kim, Daejeon (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 206 days.

(21) Appl. No.: 14/044,393

(22) Filed: Oct. 2, 2013

(65) Prior Publication Data

US 2014/0116861 A1 May 1, 2014

(30) Foreign Application Priority Data

Nov. 1, 2012 (KR) ..... 20-2012-0009996 U

(51) Int. Cl.

| | |
|---|---|
| ***H01H 1/20*** | (2006.01) |
| *H01H 71/24* | (2006.01) |
| *H01H 73/04* | (2006.01) |

(52) U.S. Cl.

CPC ..... *H01H 1/2058* (2013.01); *H01H 1/2041* (2013.01); *H01H 1/205* (2013.01); *H01H 71/2472* (2013.01); *H01H 73/045* (2013.01)

(58) Field of Classification Search

CPC .... H01H 1/205; H01H 73/045; H01H 1/2058
USPC ..... 200/302.1, 302.2, 242, 238, 262, 244; 218/154, 22

See application file for complete search history.

(56) References Cited

U.S. PATENT DOCUMENTS

| | | | | |
|---|---|---|---|---|
| 7,189,935 | B1 * | 3/2007 | Hassan et al. | 200/244 |
| 2012/0169440 | A1 | 7/2012 | An | |

FOREIGN PATENT DOCUMENTS

| | | | | |
|---|---|---|---|---|
| CN | 101660935 | | 3/2010 | |
| CN | 102386029 | | 3/2012 | |
| DE | 10-2008-047247 | | 4/2010 | |
| EP | 0978858 | * | 7/1999 | H01H 1/205 |
| EP | 0978858 | | 2/2000 | |
| EP | 1079409 | | 2/2001 | |
| EP | 2009658 | | 12/2008 | |
| EP | 2472537 | | 7/2012 | |

OTHER PUBLICATIONS

European Patent Office Application Serial No. 13187023.0, Search Report dated Apr. 22, 2014, 6 pages.

The State Intellectual Property Office of the People's Republic of China Application Serial No. 201310471058.X, Office Action dated May 5, 2015, 6 pages.

* cited by examiner

*Primary Examiner* — Renee S Luebke
*Assistant Examiner* — Ahmed Saeed
(74) *Attorney, Agent, or Firm* — Lee, Hong, Degerman, Kang & Waimey

(57) ABSTRACT

The present disclosure is to provide a movable contact arm capable of securing a revolution radius to a closed position of the movable contact arm such that adhesive materials on the shaft due to arc scattering materials can be removed with no installation of additional elements, and a movable contact arm according to the present disclosure may comprise an adhesive material removal portion formed on a lateral surface at which a contact of the movable contact arm is located, and configured to minimize a contact area with adhesive materials so as to remove the adhesive materials due to an arc.

2 Claims, 2 Drawing Sheets

MOVABLE CONTACT ARM FOR MOLDED CASE CIRCUIT BREAKER AND MOVABLE CONTACT ARM ASSEMBLY

CROSS-REFERENCE TO RELATED APPLICATIONS

Pursuant to 35 U.S.C. §119(a), this application claims the benefit of earlier filing date and right of priority to Korean Application No. 20-2012-0009996, filed on Nov. 1, 2012, the contents of which is incorporated by reference herein in its entirety.

BACKGROUND OF THE INVENTION

1. Field of the Invention

The present disclosure relates to a molded case circuit breaker (abbreviated as a "MCCB" hereinafter), and more particularly, to a movable contact arm and a movable contact arm assembly for a circuit breaker capable of removing adhesive materials formed such that foreign substances such as scattering materials due to arc generation is stuck to a shaft.

2. Description of the Related Art

The MCCB is an electric power device having a function for switching a relatively low voltage electric power circuit with several hundred volts and a protection function capable of detecting a fault current such as an over current or short-circuit current when it occurs on the circuit to automatically trip the circuit, thereby protecting the circuit and an electric load device connected to the circuit.

Such a MCCB, as is well known, may largely include a stationary contact arm configured to be electrically connected to the power source side of the circuit, a movable contact arm configured to be electrically connected to the load side of the circuit and revolved to a closed position brought into contact with the corresponding stationary contact arm and an open position separated from the corresponding stationary contact arm, a switching mechanism configured to provide a driving force for driving the corresponding movable contact arm to the closed or open position, a shaft configured to be revolved by a driving force from the switching mechanism so as to support the movable contact arm and constitute a movable contact arm assembly along with the movable contact arm, a trip mechanism configured to detect a fault current when it occurs on the circuit and trigger the switching mechanism to drive the movable contact arm to the open position, an extinguishing mechanism configured to extinguish an arc occurring during the switching of the circuit, and an enclosure for accommodating the constituent elements.

The present disclosure relates to a movable contact arm and a movable contact arm assembly among the constituent elements of the molded case breaker, and an example of the related art may refer to Korean Patent No. 10-1141537 (Title of Invention: Movable contact arm assembly for current limiting molded case circuit breaker) granted to the applicant of the present invention, and thus the detailed description of the illustrated configuration and operation will be omitted.

However, according to the related art, there is no solutions to the occurrence of a phenomenon of reducing or limiting the revolution radius to the closed position of the movable contact arm in which foreign substances such as arc scattering materials due to an arc generated during the switching of the circuit is stuck to the stopper portion of the shaft which determines the revolution limit to the closed position of the movable contact arm.

For the problems of obstructing the revolution radius of the movable contact arm and reducing the circuit switching performance due to such adhesive materials, there has been contrived a method for providing an additional synthetic resin remolded barrier having excellent heat resistance performance on a path between a contact portion generating an arc and an opening portion of the shaft to prevent adhesive materials from being generated, but it has caused a problem in which the production cost of the molded case breaker is increased due to additional elements and the installation space is limited due to the other existing elements of the molded case breaker.

SUMMARY OF THE INVENTION

Accordingly, the present disclosure is contrived to solve the foregoing problem of the related art, and an object of the present disclosure is to provide a movable contact arm capable of securing a revolution radius to a closed position of the movable contact arm such that adhesive materials on the shaft due to arc scattering materials can be removed with no installation of additional elements.

Another object of the present disclosure is to provide a movable contact arm assembly capable of securing a revolution radius to a closed position of the movable contact arm such that adhesive materials on the shaft due to arc scattering materials can be removed with no installation of additional elements.

The one object of the present disclosure may be accomplished by providing a movable contact arm for a molded case circuit breaker, comprising:

an adhesive material removal portion formed on a lateral surface at which a contact of the movable contact arm is located, and configured to minimize a contact area with adhesive materials so as to remove the adhesive materials due to an arc.

The another object of the present disclosure may be accomplished by providing a movable contact arm assembly for a molded case circuit breaker, comprising:

a movable contact arm; and a shaft configured to support and drive the movable contact arm to a circuit open position or circuit closed position, and having a stopper portion for determining a revolution limit to the circuit closed position of the movable contact arm, wherein the movable contact arm comprises:

an adhesive material removal portion formed on a lateral surface at which a contact of the movable contact arm is located, and configured to minimize a contact area with adhesive materials so as to remove the adhesive materials stuck to the stopper portion of the shaft due to an arc.

According to a preferred aspect of the present disclosure, the longitudinal cross section of the adhesive material removal portion may have a wedge shape.

According to a preferred aspect of the present disclosure, the longitudinal cross section of the adhesive material removal portion may have an arc shape.

According to a preferred aspect of the present disclosure, the longitudinal cross section of the adhesive material removal portion may have a saw teeth shape.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
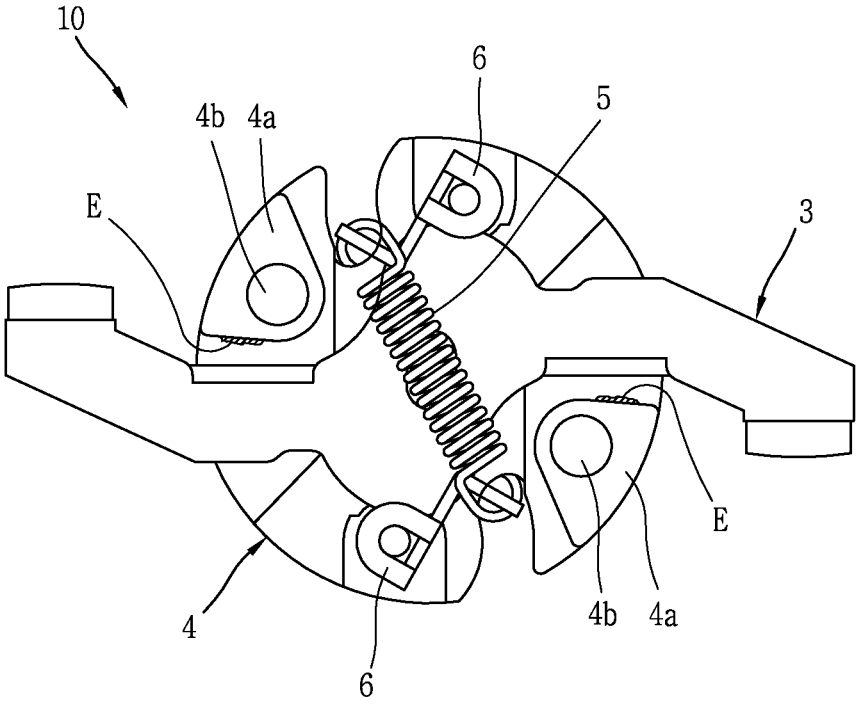
FIG. 1 is a longitudinal cross-sectional view illustrating the configuration of a movable contact arm assembly according to a preferred embodiment of the present disclosure in which a shaft is cut in a longitudinal direction to expose the internal configuration thereof.

The objective of the present disclosure, as well as the configuration and working effect thereof to accomplish the foregoing objective will be more clearly understood by the following description for the preferred embodiments of present disclosure with reference to the accompanying drawings.

First, the configuration of a movable contact arm assembly for a molded case circuit breaker according to a preferred embodiment of the present disclosure will be described with reference to FIG. 1.

A movable contact arm assembly 10 for a molded case circuit breaker according to a preferred embodiment of the present disclosure may comprise a movable contact arm 3 and a shaft 4 as illustrated in the drawing.

Figure 2:
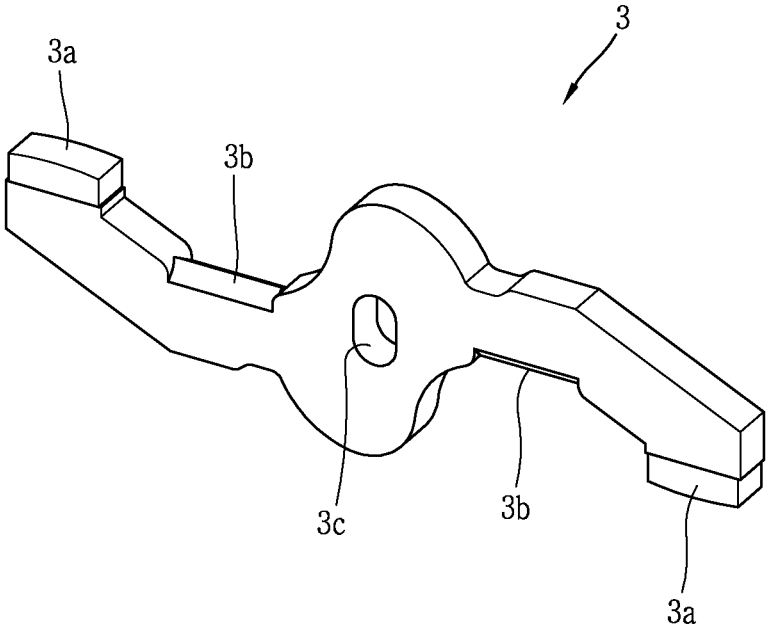
FIG. 2 is a perspective view illustrating the configuration of a movable contact arm according to a preferred embodiment of the present disclosure.

The movable contact arm 3 may be configured with a pair contact type movable contact arm having contacts 3*a*, respectively, on both end portions in the length direction, and comprise adhesive material removal portions 3*b* according to a preferred aspect of the present disclosure as illustrated in FIG. 2.

The adhesive material removal portion 3*b* is formed on a lateral surface at which a contact of the movable contact arm is located, and has a configuration for minimizing a contact area with adhesive materials (refer to reference character "E" in FIG. 1) to remove the adhesive materials adhered to the stopper portion 4*a* of the shaft 4 due to an arc.

The configuration of the adhesive material removal portion 3*b* according to various embodiments will be described later with reference to FIGS. 3 through 5.

The shaft 4 is configured to support and drive the movable contact arm 3 to a circuit open position or circuit closed position, and the shaft 4 has a stopper portion 4*a* to determine a revolution limit to the circuit closed position of the movable contact arm 3. In FIG. 1, according to a preferred embodiment, the stopper portion 4*a* may be configured with a pair of stopper portions 4*a* disposed symmetrically to each other, and shaft pin holes 4*b* are provided at the central portions of the stopper portions 4*a*, respectively. Shaft pins which are not shown for transferring a rotational driving force from a switching mechanism which is not shown may be provided to pass through the shaft pin holes 4*b*, respectively.

As illustrated in FIG. 1, the movable contact arm assembly 10 for a molded case circuit breaker according to a preferred embodiment of the present disclosure may further comprise a spring 5 and a contact lever 6.

The spring 5 is a contact pressure spring (namely, pressure spring) for maintaining a state in which the movable contact arm 3 is brought into contact with the corresponding stationary contact arm when the movable contact arm 3 of the movable contact arm assembly 10 is brought into contact with the stationary contact arm which is not shown to flow a current on the circuit. However, during a current limiting operation in which the movable contact arm 3 is revolved to be separated from the corresponding stationary contact arm by an electromagnetic repulsive force generated between the contact 3*a* of the movable contact arm 3 and the contact of the corresponding stationary contact arm according to the conduction of an abnormal large current on a circuit, the spring 5 may exert a force at a predetermined revolution point (namely, dead point) of the movable contact arm 3 in the direction of the movable contact arm 3 being separated from the corresponding stationary contact arm to prevent the movable contact arm 3 from being returned in the direction of being brought into contact with the corresponding stationary contact arm through the contact lever 6. The more detailed description of the configuration and operation of the spring 5 and contact lever 6 is disclosed in the foregoing publication of Korean Patent Registration No. 10-1141537 (Title of Invention: Movable contact arm assembly for current limiting molded case breaker), and thus the detailed description thereof will be omitted.

On the other hand, the configuration of an adhesive material removal portion 3*b* according to various embodiments will be described with reference to FIGS. 2 through 5.

Figure 3:
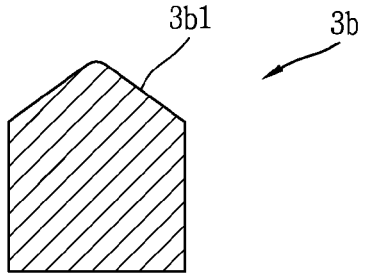
FIG. 3 is a longitudinal cross-sectional view of a movable contact arm illustrating the configuration of an adhesive material removal portion according to a first preferred embodiment of the present disclosure.

The adhesive material removal portion 3*b* according to a first preferred embodiment of the present disclosure may be configured such that the longitudinal cross section thereof has a wedge-shaped leading end surface 3*b*1 with a wedge shape (namely, alphabet "V"-shape) as illustrated in FIG. 3.

The adhesive material removal portion 3*b* according to the foregoing embodiment may be configured with a continuous wedge shape, namely, alphabet "V" shape which is sharply protruded on a lateral surface at which the contact is located and its protruded height is linearly continuous as illustrated in FIG. 2.

Figure 5:
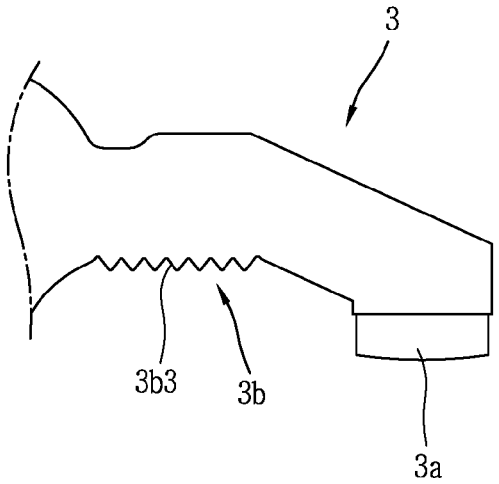
FIG. 5 is a partial side view of a movable contact arm illustrating the configuration of an adhesive material removal portion according to a second preferred embodiment of the present disclosure.

Furthermore, the adhesive material removal portion 3*b* according to the first embodiment may be configured such that the lateral surface thereof has a saw teeth shape, namely, a saw teeth shaped leading end surface 3*b*3 on which sharply protruded portions and depressed portions are formed like a plurality of teeth on the lateral surface at which the contact is located as illustrated in FIG. 5. The foregoing embodiment with such a saw teeth shaped lateral surface may be also formed in such a manner that the longitudinal cross section thereof has a wedge shape as illustrated in FIG. 3.

Figure 4:
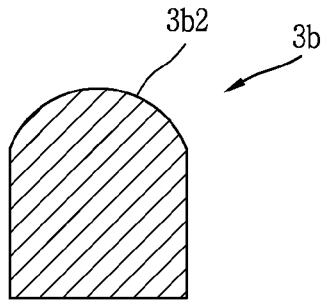
FIG. 4 is a longitudinal cross-sectional view of a movable contact arm illustrating the configuration of an adhesive material removal portion according to a second preferred embodiment of the present disclosure.

The adhesive material removal portion 3*b* according to a second preferred embodiment of the present disclosure may be configured such that the longitudinal cross section thereof has an arc shape with an arc-shaped leading end surface 3*b*2 as illustrated in FIG. 4.

On the other hand, the working effect of a movable contact arm and a movable contact arm assembly for a molded case circuit breaker according to a preferred embodiment of the present disclosure will be described below with reference to FIG. 1.

The molded case circuit breaker generates an arc between contacts during the switching of a circuit being conducted, and scattering materials due to such arc generation are adhered to the stopper portion 4*a* of the shaft 4 in FIG. 1 to generate adhesive materials (E).

A movable contact arm and a movable contact arm assembly for a molded case circuit breaker according to a preferred embodiment of the present disclosure may have the adhesive material removal portion 3*b* configured to minimize a contact area with adhesive materials (refer to symbol "E" in FIG. 1), and when the movable contact arm 3 and movable contact arm assembly 10 of the molded case circuit breaker are driven to a location in contact with the corresponding stationary contact arm (not shown), the adhesive material removal portion 3*b* may break the adhesive materials (E) while striking a blow at the adhesive materials (E), thereby removing them.

In a movable contact arm for a molded case circuit breaker according to a preferred embodiment of the present disclosure, the longitudinal cross section of the adhesive material removal portion 3*b* has a wedge shaped leading end surface 3*b*1 with a wedge shape, and thus the wedge shaped leading end surface 3*b*1 of the sharply wedge shaped adhesive material removal portion 3*b* may effectively break the adhesive materials to remove them.

In a movable contact arm for a molded case circuit breaker according to another preferred embodiment of the present disclosure, the longitudinal cross section of the adhesive material removal portion 3*b* has an arc shaped leading end surface 3*b*2 with an arc shape, and thus a contact area with the adhesive materials (E) may be minimized during the foregoing closing operation, thereby obtaining the effect of preventing the adhesive materials (E) from being pressed or stuck to the adhesive material removal portion 3*b* as well as breaking the adhesive materials (E) to remove them.

In a movable contact arm for a molded case circuit breaker according to the present disclosure, the lateral surface of the adhesive material removal portion 3*b* has a saw teeth shaped leading end surface 3*b*3 with a saw teeth shape, and thus a contact area with the adhesive materials (E) may be minimized, thereby obtaining the effect of preventing the adhesive materials (E) from being pressed or stuck to the adhesive material removal portion 3*b* during the foregoing closing operation as well as breaking the adhesive materials (E) to remove them.

A movable contact arm assembly for a molded case circuit breaker according to the present disclosure may comprise a movable contact arm 3 and a shaft 4 having a stopper portion 4*a* configured to support and drive the movable contact arm 3 to a circuit open position or circuit closed position, and determine a revolution limit to the circuit closed position of the movable contact arm, and the movable contact arm may comprise an adhesive material removal portion 3*b* formed on a lateral surface at which a contact 3*a* of the movable contact arm is located, and configured to minimize a contact area with the adhesive materials (E) so as to remove the adhesive materials stuck to the stopper portion 4*a* of the shaft due to an arc, thereby obtaining the effect of breaking and removing the adhesive materials stuck to the stopper portion 4*a* of the shaft during the closing operation of the movable contact arm.

What is claimed is:

1. A movable contact arm for a molded case circuit breaker, the movable contact arm comprising:

an adhesive material removal portion formed on a lateral surface, the adhesive material removal portion removing adhesive materials loosened by an arc contacting the adhesive materials according to movement of the movable contact arm; and a contact located on the lateral surface, wherein the adhesive material removal portion comprises a longitudinal cross section having a wedge shape, an arc shape or a saw teeth shape that minimizes a contact area with the adhesive materials; wherein the adhesive material removal portion and the contact are located on different portions of the lateral surface.

2. A movable contact arm assembly for a molded case circuit breaker, the moveable contact arm assembly comprising: a movable contact arm; a shaft configured to support and drive the movable contact arm to a circuit open position or circuit closed position, the shaft comprising a stopper portion for determining a revolution limit for the circuit closed position; and a contact located on a lateral surface of the movable contact arm, wherein the movable contact arm comprises an adhesive material removal portion formed on the lateral surface, the adhesive material removal portion removing adhesive materials stuck to the stopper portion due to an arc contacting the adhesive materials according to movement of the movable contact arm, and wherein the adhesive material removal portion comprises a longitudinal cross section having a wedge shape, an arc shape or a saw teeth shape that minimizes a contact area with the adhesive materials; wherein the adhesive material removal portion and the contact are located on different portions of the lateral surface.

* * * * *